US006748610B2

(12) United States Patent
Zach et al.

(10) Patent No.: US 6,748,610 B2
(45) Date of Patent: Jun. 15, 2004

(54) IN-TANK DISPENSER WITH FLEXIBLE SUPPORTED VALVE HEAD

(75) Inventors: Steven A. Zach, Racine, WI (US); Kevin Harrity, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 5 days.

(21) Appl. No.: 10/282,200

(22) Filed: Oct. 25, 2002

(65) Prior Publication Data

US 2004/0078879 A1 Apr. 29, 2004

(51) Int. Cl.[7] ..... E03D 9/02

(52) U.S. Cl. ..... 4/227.1; 4/227.2; 4/227.3; 4/227.4; 4/227.5; 4/227.6; 4/227.7; 222/181; 222/453

(58) Field of Search ..... 4/227.1, 227.2, 4/227.3, 227.4, 227.5, 227.6, 227.7; 222/181, 453

(56) References Cited

U.S. PATENT DOCUMENTS

| | | | |
|---|---|---|---|
| 966,900 | A | 8/1910 | Garnet |
| 1,107,393 | A | 8/1914 | Williams |
| 1,602,554 | A | 10/1926 | Schrank |
| 2,587,388 | A | 2/1952 | Ryder, Jr. |
| 2,725,170 | A | 11/1955 | Day et al. |
| 2,913,734 | A | 11/1959 | O'Hare |
| 3,278,094 | A | 10/1966 | Perry |
| 3,416,577 | A | 12/1968 | Franz |
| 3,460,590 | A | 8/1969 | Robbins |
| 3,545,014 | A | 12/1970 | Davis |
| 3,558,097 | A | 1/1971 | DeFrees |
| 3,698,021 | A | 10/1972 | Mack et al. |
| 3,774,808 | A | 11/1973 | La Vange |
| 3,778,850 | A | 12/1973 | Bryan |
| 3,841,524 | A | 10/1974 | Easter |
| 3,848,645 | A | 11/1974 | Franz |
| 3,850,209 | A | 11/1974 | Zweigardt |
| 3,871,425 | A | 3/1975 | Fee et al. |
| 3,874,007 | A | 4/1975 | Dolan |
| 3,883,024 | A | 5/1975 | Thomas |
| 3,913,151 | A | 10/1975 | Keimig |
| 4,066,187 | A | 1/1978 | Nieman et al. |
| 4,101,043 | A | 7/1978 | Johnson, Jr. et al. |
| 4,189,793 | A | 2/1980 | Williamson et al. |
| 4,285,074 | A | 8/1981 | Leinberry |
| 4,346,483 | A | 8/1982 | Rosen et al. |
| 4,356,848 | A | 11/1982 | Spies |
| 4,415,314 | A | 11/1983 | Chappell |
| 4,429,809 | A | 2/1984 | Bousgarbies |
| 4,436,269 | A | 3/1984 | Dirksing et al. |
| 4,534,071 | A | 8/1985 | Russomanno |
| 4,598,743 | A | 7/1986 | Milling |
| 4,660,231 | A | 4/1987 | McElfresh et al. |
| 4,663,786 | A | 5/1987 | Kirkpatrick |

(List continued on next page.)

FOREIGN PATENT DOCUMENTS

| | | |
|---|---|---|
| EP | 1026331 | 8/2000 |
| GB | 538905 | 8/1941 |
| GB | 2167041 | 5/1986 |
| WO | WO 99/08076 | 2/1999 |
| WO | WO 02/064897 A1 | 8/2002 |

*Primary Examiner*—Henry Bennett
*Assistant Examiner*—Azadeh Kokabi

(57) ABSTRACT

A toilet tank cleanser dispenser has a receiving holster suitable to receive an inverted container of cleaning composition and suitable to dose liquid from the container. The adapter has an internal dosing shuttle for metering an aliquot of cleanser through an opening at the bottom of the adapter defining a valve seat. A float can move up and down with respect to the liquid level in the tank to drive an outlet valve against an outlet of the adapter. The valve head can have a balloon-like structure driven by the float. For example, a low density thin wall polyethylene valve head can be supported by a trapped air pocket to reduce leakage, permit some flexibility, and avoid permanent deformation.

16 Claims, 3 Drawing Sheets

U.S. PATENT DOCUMENTS

| | | | |
|---|---|---|---|
| 4,696,414 | A | 9/1987 | Huat |
| 4,915,260 | A | 4/1990 | Jones |
| 4,916,760 | A | 4/1990 | Shahar |
| 4,924,921 | A | 5/1990 | Simmel et al. |
| 5,038,417 | A | 8/1991 | Bavaveas |
| 5,058,636 | A | 10/1991 | Simmel et al. |
| 5,083,593 | A | 1/1992 | Fogg |
| 5,090,443 | A | 2/1992 | Jacobsen |
| 5,152,015 | A | 10/1992 | Fourman |
| 5,259,423 | A | 11/1993 | Simmell et al. |
| D365,138 | S | 12/1995 | Puri |
| 5,488,742 | A | 2/1996 | Liao |
| 5,505,236 | A | 4/1996 | Grabenkort et al. |
| 5,551,095 | A | 9/1996 | Chen |
| D376,840 | S | 12/1996 | Perkins |
| 5,718,261 | A | 2/1998 | Chen |
| 5,839,128 | A | 11/1998 | Wang |
| 5,878,798 | A | 3/1999 | Harris et al. |
| 5,896,887 | A | 4/1999 | Edwards |
| 5,903,930 | A | 5/1999 | Huang |
| 5,924,142 | A | 7/1999 | Wang |
| 5,996,966 | A | 12/1999 | Zimmerly |
| 6,056,270 | A | 5/2000 | Zimmerly |
| 6,123,099 | A | 9/2000 | Edwards |
| 6,212,692 | B1 | 4/2001 | Hu |
| 6,286,880 | B1 | 9/2001 | Pratt |

IN-TANK DISPENSER WITH FLEXIBLE SUPPORTED VALVE HEAD

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to dispensers used in liquid holding tanks in which the liquid level changes, and in particular such dispensers which dispense cleanser into toilet tanks.

A variety of dispensers exist for automatically dispensing chemicals into a water tank. See for example U.S. Pat. Nos. 5,924,142; 5,903,930; 5,839,128; 5,718,261; D376,840; 5,551,095; 5,488,742; D365,138; 5,152,015; 5,090,443; 5,038,417; 4,915,260; 4,696,414; 4,663,786; 4,660,231; 4,534,071; 4,429,809; 4,346,483; 4,285,074; 4,189,793; 4,101,043; 3,913,151; 3,874,007; 3,778,850; 3,698,021; 2,587,388; and 1,602,554. See also GB 2,167,041; EP 1,026,331; and WO 99/08076. See also Ser. No. 10/142,708 filed May 10, 2002. The disclosure of these publications and applications are incorporated by reference as if fully set forth herein. A number of these automated dispenser systems use some type of float that follows the water level in the tank to control dispensing.

Many such conventional automatic dispensers have a tendency for the product that is being dispensed to leak out of the dispenser in a somewhat uncontrolled manner. This tendency can increase the longer the particular dispenser is used. This can result in overdosing of the product or the uncontrolled draining of the liquid into the bowl, and thus waste of cleaning compositions.

Leakage of this type can arise from improper sealing of the valve head against the valve seat, which can be caused by insufficient buoyant forces acting on the valve. An even more important cause of such leakage is that the sealing surfaces that control outflow become degraded over time due to prolonged exposure to the tank water or the cleanser. This is particularly of concern where one or more valve elements are made of rubber.

Even if non-rubber materials are substituted for the rubber in such valve seat and valve head applications, leakage can still occur. In this regard, some materials are too inflexible to consistently insure a non-leaking seal. Others, while being suitable for sealing when they are properly configured, tend to be too flexible (such that they are subject to non-resilient deformation during use).

Accordingly, there is still a need in the art for dispensers of this type having improved outlet valving parts (particularly valve heads) that are resistant to degradation in the environment of stringent cleaning chemicals, yet otherwise suitable for use.

SUMMARY OF THE INVENTION

In one aspect the invention provides a dispenser for dispensing a composition (for example a liquid toilet bowl cleaner) from a container in response to liquid level changes in a tank. The dispenser has a receiver (for example an upwardly open holster) suitable to receive the container and to dose composition received from the container to a valve seat defining a flow opening. The dispenser also has a valve for controlling outflow through the flow opening, the valve having a flexible head supported by an essentially trapped gas pocket. Typically, the valve will be linked to a float suitable to follow liquid level changes in the tank.

In one aspect the valve has an upper dome structure, a lower plug, and a trapped air pocket between the dome structure and plug. In an alternative structure the valve has an upper dome structure mounted on the float to create a trapped air pocket there between, and the upper dome structure is not integral with the portion of the float upon which it is mounted. In this latter embodiment the float can have an integral upwardly extending hub upon which the dome structure is mounted with an interference fit.

Most preferably at least a part of an upper portion of the head is a moldable flexible plastic such as polyethylene having a density of less than 1 grams/cubic centimeter ("g/cm$^3$"), where at least a portion of the head has a wall thickness of less than 0.05 centimeter ("cm").

The invention provides a way of improving the anti-leakage capabilities of dispensers of this type. The trapped air pocket permits some flexibility of the valve head when a thin walled plastic (a degradation-resistant material) is used, but nevertheless sufficiently supports the head such that the head will not permanently deform.

The valve head can be molded in two parts which are then combined to create a trapped air pocket. Alternatively, other ways of forming the trapped air pocket can be used (albeit these may be more expensive to implement on a commercial scale).

The net result is a dispenser with a very low rate of uncontrolled leakage. Importantly, this advantage is achieved inexpensively, and can be maintained over long term use.

These and still other advantages of the invention will be apparent from the detailed description and drawings. What follows are preferred embodiments of the present invention. To assess the full scope of the invention the claims should be looked to as the preferred embodiments are not intended as the only embodiments within the scope of the invention.

DETAILED DESCRIPTION OF THE PREFERRED EMBODIMENTS

The preferred embodiments of the present invention are incorporated into dispensers that deliver toilet cleaning concentrate to a toilet tank during the down stroke of the flushing cycle in the toilet tank. It will be readily appreciated from the present disclosure that the invention will be suitable for use in any tank that delivers a liquid, and that the state or type of composition being delivered (for example gel, liquid, fragrancer, pool chlorinator) is not critical.

The invention focuses on a multi-piece (typically two-piece) structure formed as part of the valve head which controls outflow from the dispenser. A trapped air pocket provides unique support for the valve head.

Apart from the valve head and adjacent structures, dispensers of this type are described in detail in commonly owned U.S. Ser. No. 10/142,708, filed May 10, 2002. Nevertheless, significant attributes of the operation of one such dispenser of that type will be described below for purposes of additional background.

Figure 1:
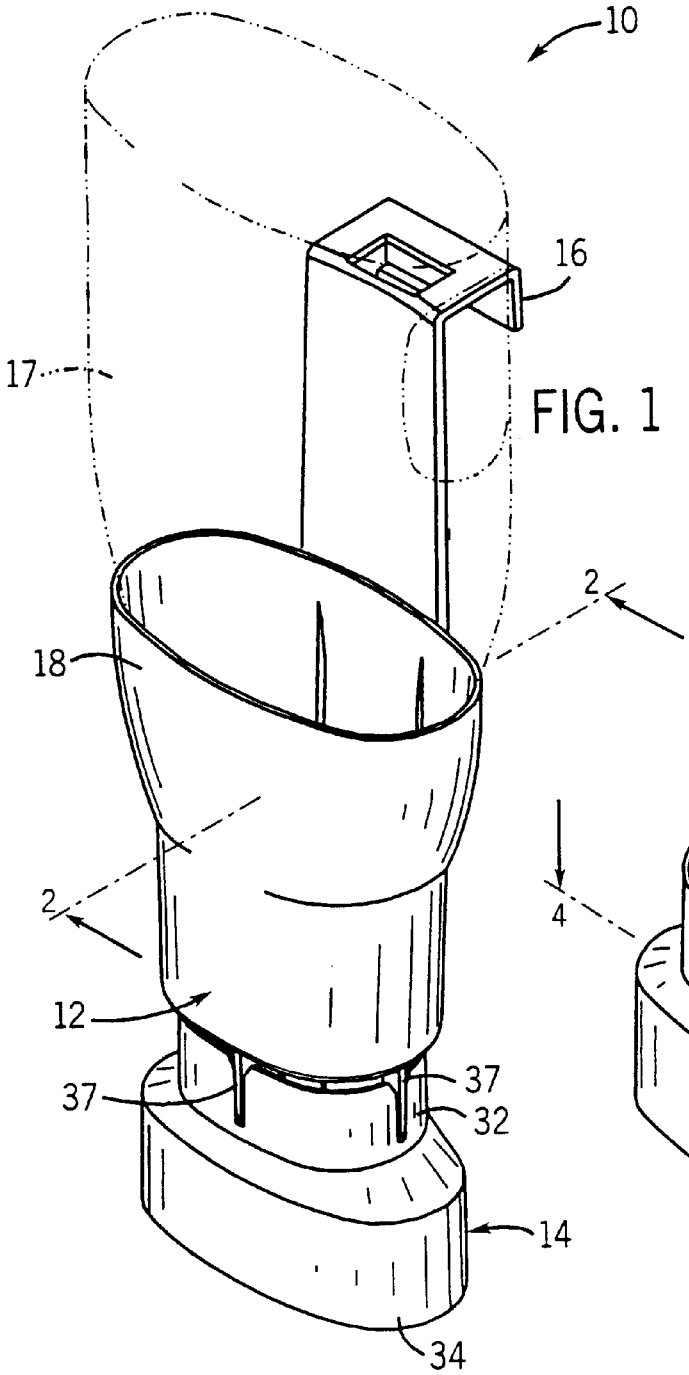
FIG. 1 is a front, right, and upper perspective view of an in-tank dispenser of the present invention, with a replaceable bottle containing cleaner to be dispensed shown in phantom.
Figure 2:
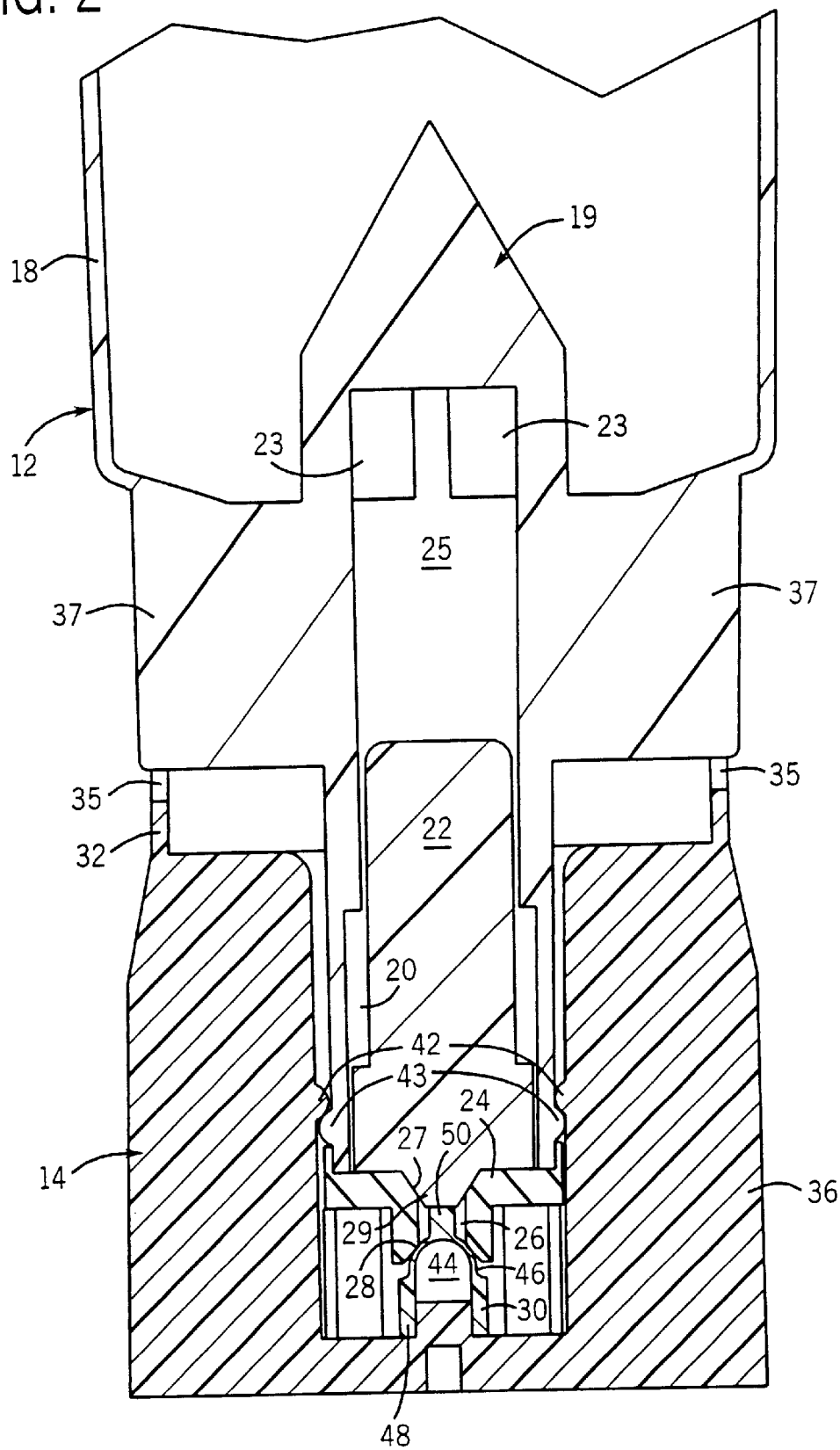
FIG. 2 is a partial cross-sectional view taken along line 2—2 of FIG. 1.

Referring now to FIGS. 1 and 2, the dispenser 10 has a receiver 12 and a main float 14, both formed from a durable material capable of withstanding prolonged immersion in water and capable of resisting the corrosive effects of the product it dispenses. Plastics such as polypropylene or acrylic are most preferred for this purpose.

The receiver 12 can have a hanger 16 for suspending the dispenser from a wall of the tank such that the normal fill level of the tank is near the top of the float 14. The receiver 12 defines a holster cavity 18 for receiving a rigid bottle, flexible pouch, or other container 17 (shown in phantom) having a dispensable product therein. The dispensable product is flowable (for example a liquid or a gel) and is preferably a toilet cleaner or freshener having a viscosity of at least 30 centa-Poise ("cP") or higher, preferably 100 cP or higher.

The container 17 is preferably vented by an opening in its top (above the highest normal water level in the tank) or the receiver 12 can define its own air inlet feature creating a passage for air to get inside the container as the product is being dispensed. In either case, air will be allowed to flow into the container 17 to replace the amount of dispensed product to prevent gurgling.

A breakable seal, formed of a metal foil or plastic, extends over the mouth of the container when it is stored for sale (if it is a bottle) allowing the container 17 to be turned upside-down for insertion onto the dispenser without any leakage of the product. The seal is broken while being inserted into the receiver 12 by a piercing post 19 with an upper pointed portion, side openings 23 and a central axial bore 25. After the seal is broken, the product flows freely from the container into the receiver 12.

The receiver 12 preferably has a necked down section leading from the bore 25 to a dosing chamber 20, in which a defined quantity of the product is staged for release into the tank. The dosing chamber 20 has a floating shuttle 22 captured therein so as to move freely up and down within the dosing chamber 20. The bottom end of the dosing chamber 20 is closed off by a cap grommet 24, preferably a silicone rubber or plastic, defining a valve outlet 26 and upper 27 and lower 28 valve seats.

The valve seats can be conical, hemi-spherical or of other suitable configurations. If desired, the upper surface of the cap grommet 24 can be made of a softer material than the lower surface. This allows the seal with the shuttle 22 to be optimal, while leaving the exposed surface at the bottom of the grommet able to resist degradation from the toilet tank environment.

The shuttle 22 is made of a material having a lower specific gravity than the product to be dispensed. The shuttle 22 could also be a hollow construction. As product passes past and under the shuttle 22, the shuttle 22 will therefore float on the product within the dosing chamber 20 if the valve outlet 26 is closed. The shuttle 22 has a downwardly extending nib 29 which mates with the upper valve seat 27 as described below.

Figure 3:
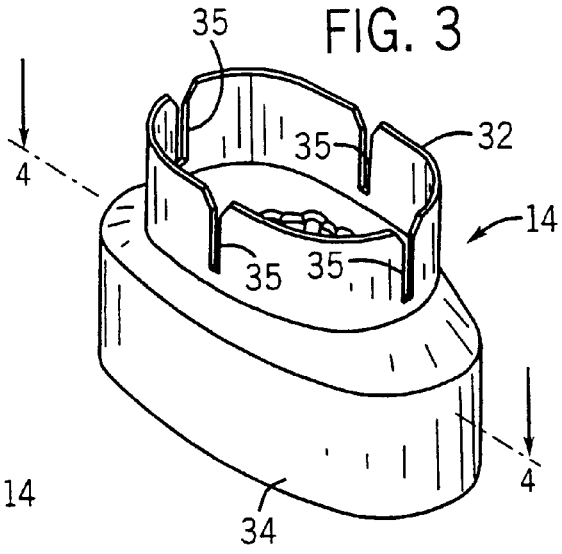
FIG. 3 is a front, right and upper slightly enlarged perspective view of the bottom float of FIG. 1.
Figure 4:
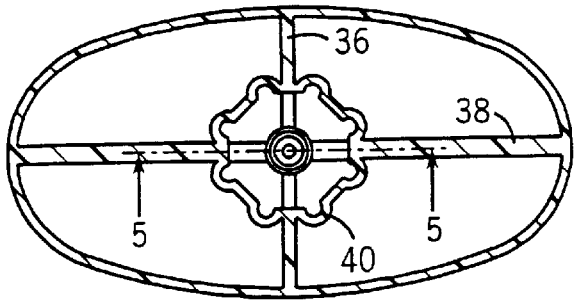
FIG. 4 is a cross-sectional view taken along line 4—4 of FIG. 3.

The valve outlet 26 is primarily controlled by an upwardly extending valve head 30 of the float 14, see FIGS. 3 and 4. The float 14 has a segmented upper rim 32 and a lower skirt 34 supported by cross-braces 36 and 38. The upper rim has four slots 35 that slidably receive four alignment vanes 37 of the adapter 12 to prevent relative rotation of these components.

The valve head 30 is disposed at the intersection of the cross-braces 36 and 38 in the center of a baffle 40. The baffle has four projections 42 (two shown in FIG. 5) that snap over one or more outward projections 43 (see FIG. 2) of the adapter 12 so that the float 14 does not separate from the adapter 12, but is free to slide up and down with respect thereto during the flush cycle.

The valve provided by the float 14 is a "zero-force" valve in that it does not provide any independent biasing force. The valve operates solely by gravity and buoyancy forces provided by the water in the tank.

Figure 5:
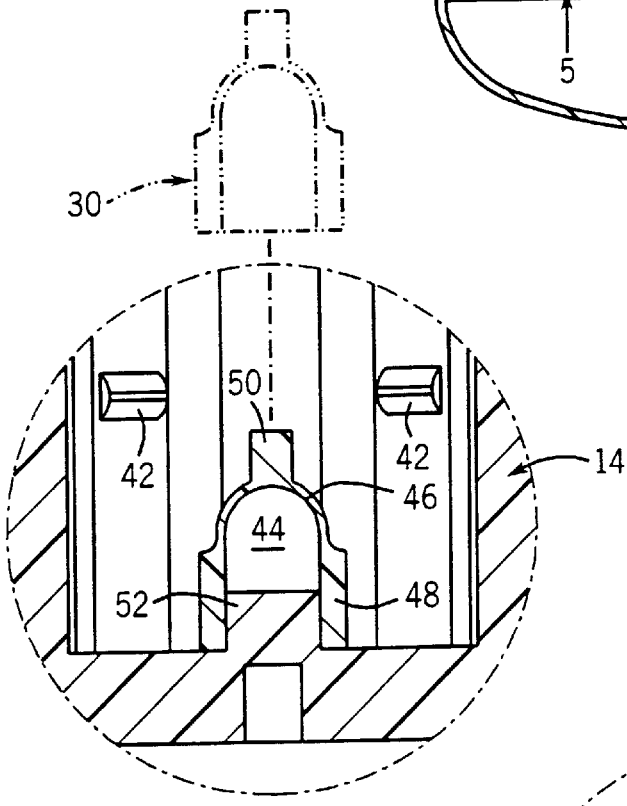
FIG. 5 is an enlarged cross sectional view taken along line 5—5 of FIG. 4.

The top of the valve head that contacts the seat 28 is supported by a pocket of trapped gas such as air 44. Referring next to FIGS. 2 and 5, the valve head 30 is preferably thin and flexible so as to assist in forming a good seal against seat 28. The preferred material for portion 46 is an ultra low density polyethylene, preferably one having a density of less than 1 g/cm$^3$, for example about 0.9 g/cm$^3$ (for example Exact 3040 from Exxon).

In an especially preferred form the wall thickness at upper (sealing) portion 46 is 0.01–0.05 cm, preferably 0.02 cm. A lower (non-sealing) portion 48 of the valve head 30, and an upwardly extending pin 50, are preferably two or three times as thick.

FIG. 5 illustrates in an enlarged view one preferred embodiment in which the valve head 30 is a separate piece that mounts to an upstanding hub 52 formed in the float 14. The valve head 30 is mounted in any suitable manner to form a hermetic seal, such as by interference fit, adhesion or ultra-sonic welding.

In any event, it is particularly desirable that air in pocket 44 be trapped, which herein means essentially trapped such that, while slight leakage may occur, during normal use the air will support the thinned sealing portion 46 of the valve head 30 in its hemispherical shape and thus resist excessive deflection that might lead to non-resilient deformation. It does allow some deflection so that the head 30 can conform (at least somewhat) to the seat 28.

Figure 6:
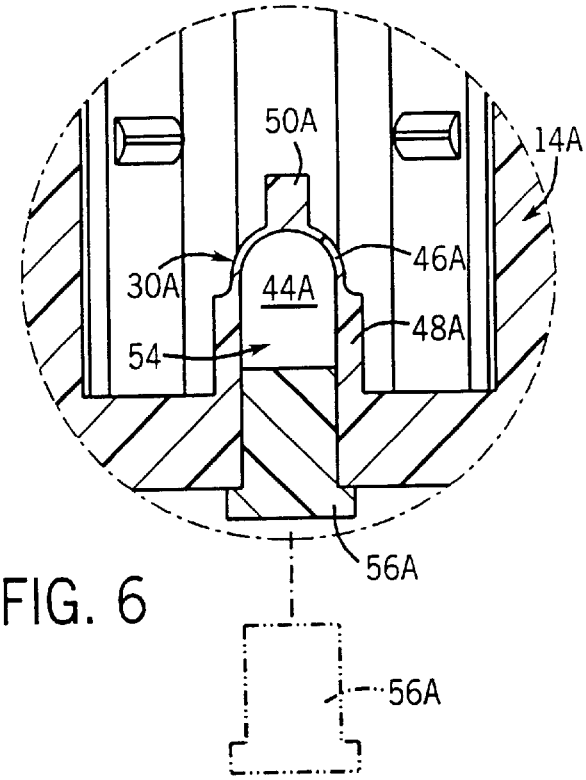
FIG. 6 is a view similar to FIG. 5, but of an alternate embodiment.

FIG. 6 shows another embodiment of the float 14A in which the valve head 30A is molded as a unitary part of the float 14A. Here, the valve head 30A defines a cavity 54 opening at the bottom of the float 14A. This opening is hermitically sealed by a bottom plug 56A secured to the float 14A, again for example, by interference fit, adhesion or ultra-sonic welding. Securing the plug 56A to the float 14A forms air pocket 44A between the valve head 30A and the plug 56. The valve head 30A is otherwise as described above.

In use the dispenser 10 hangs from the toilet tank wall. The container 17 is inverted and slid into the receiver 12 so that the piercing post 19 breaks the seal on the container 17, permitting the product to drain downward through the side openings 23 and bore 25 and into the dosing chamber 20. The float 14 is in its highest position when the tank is full such that the valve head 30 is fully engaged with the lower valve seat 28 to close the valve outlet 26. As the dosing chamber 20 fills, the shuttle 22 floats to the top of the chamber to close the side openings 23 and prevent further flow of the product.

When the toilet is flushed, the water level in the tank decreases in the usual manner. As the water level decreases, the float 14 begins to drop, opening the valve outlet 26. The product held in the dosing chamber 20 beneath the shuttle 22 rapidly flows out through the valve outlet 26 and through openings in the float 14 around the valve head 30. The shuttle 22 then drops via gravity to the bottom of the dosing chamber 20 so that its tapered nib 29 seals against the upper valve seat 27.

In this position the shuttle 22 substantially seals off the outlet valve hole 26 to prevent excessive dispensing of the product during a flush cycle. Thus, regardless of how quickly the tank is refilled, only a single measured aliquot of cleaner will be dispensed during the down stroke of each flush. As the dose of product is released, air travels into the container (either via an air inlet or a vent opening) to replace the volume of product that leaves the container. The shuttle 22 remains at the bottom of the dosing chamber 20 until the water level rises sufficiently to drive the float 14 and mate the valve head 30 against the valve seat 28. Either by pressure buildup, or preferably by direct contact with the pin 50 of the valve head 30, the shuttle 22 is raised slightly in the dosing chamber 20 so that product can bleed past the sides of the shuttle 22 and cause it to once again quickly float to the top of the dosing chamber 20.

It should be appreciated that preferred embodiments of the invention have been described above. However, many modifications and variations to these preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The invention provides an improved in-tank dispenser with a balloon outlet control valve.

What is claimed is:

1. A dispenser for dispensing a composition from a container in response to liquid level changes in a tank, the dispenser comprising:

a receiver suitable to receive the container and to dose composition received from the container to a valve seat defining a flow opening; and a valve for controlling outflow through the flow opening, the valve having a head defining a sealing portion that is matable with the opening and defining a supporting portion adjacent the sealing portion at a different vertical location and of a wall thickness at least two times that of the sealing portion such that the sealing portion is supported by the supporting portion and a trapped gas pocket.

2. The dispenser of claim 1, wherein the valve is linked to a float suitable to follow liquid level changes in the tank.

3. The dispenser of claim 1, wherein the valve head defines a dome structure, and wherein the trapped air pocket is formed between the dome structure and a plug.

4. The dispenser of claim 2, wherein the valve head defines a dome structure mounted on the float to create the trapped air pocket there between, and the dome structure is not integral with the portion of the float upon which it is mounted.

5. The dispenser of claim 4, wherein the float has an integral upwardly extending hub upon which the dome structure is mounted with an interference fit.

6. The dispenser of claim 1, wherein the sealing portion of the head is a moldable flexible plastic.

7. The dispenser of claim 6, wherein the plastic is a polyethylene having a density of less than 1 g/cm$^3$.

8. The dispenser of claim 7, wherein the sealing portion of the head has a wall thickness of less than 0.05 cm.

9. A dispenser for dispensing a composition from a container in response to liquid level changes in a tank, the dispenser comprising:

a receiver suitable to receive the container and to dose composition received from the container to a valve seat defining a flow opening; and a valve for controlling outflow through the flow opening, the valve having a dome structure defining a sealing portion that is matable with the opening and defining a supporting portion adjacent the sealing portion at a different vertical location and of a wall thickness at least two times that of the sealing portion such that the sealing portion is supported by the supporting portion and a trapped gas pocket, wherein the dome structure is mounted in an interference fit to a longitudinally extending hub of a float to create the trapped air pocket there between, wherein the upper dome structure is not integral with the portion of the float upon which it is mounted.

10. The dispenser of claim 9, wherein at least the dome structure is a moldable flexible plastic.

11. The dispenser of claim 10, wherein the plastic is a polyethylene having a density of less than 1 g/cm$^3$.

12. The dispenser of claim 11, wherein the sealing portion of the dome structure has a wall thickness of less than 0.05 cm.

13. A dispenser for dispensing a composition from a container in response to liquid level changes in a tank, the dispenser comprising:

a receiver suitable to receive the container and to dose composition received from the container to a valve seat defining a flow opening; and a valve for controlling outflow through the flow opening, the valve being linked to a float following liquid level changes in the tank, the float having an integral dome structure defining a sealing portion that is matable with the opening and defining a supporting portion adjacent the sealing portion at a different vertical location and of a wall thickness at least two times that of the sealing portion such that the sealing portion is supported by the supporting portion and a gas pocket trapped by a plug.

14. The dispenser of claim 13, wherein at least the dome structure is a moldable flexible plastic.

15. The dispenser of claim 14, wherein the plastic is a polyethylene having a density of less than 1 g/cm$^3$.

16. The dispenser of claim 15, wherein the sealing portion of the dome structure has a wall thickness of less than 0.05 cm.

* * * * *